US011565491B2

(12) United States Patent
Shinoda et al.

(10) Patent No.: US 11,565,491 B2
(45) Date of Patent: Jan. 31, 2023

(54) CONTROL APPARATUS OF MACHINE TOOL FOR PROCESSING OBJECT TO BE PROCESSED ON DIE CUSHION

(71) Applicant: FANUC CORPORATION, Yamanashi (JP)

(72) Inventors: Shougo Shinoda, Yamanashi (JP); Keisuke Tsujikawa, Yamanashi (JP); Satoshi Ikai, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 107 days.

(21) Appl. No.: 17/024,709

(22) Filed: Sep. 18, 2020

(65) Prior Publication Data

US 2021/0129474 A1 May 6, 2021

(30) Foreign Application Priority Data

Oct. 30, 2019 (JP) ..... JP2019-197319

(51) Int. Cl.
*B30B 15/14* (2006.01)
*B21D 24/02* (2006.01)
*B30B 15/26* (2006.01)

(52) U.S. Cl.
CPC ..... *B30B 15/148* (2013.01); *B21D 24/02* (2013.01); *B30B 15/26* (2013.01)

(58) Field of Classification Search
CPC ..... B21D 24/02; B21D 24/00; B21D 24/08; B21D 24/10; B21D 24/14; B30B 15/166; B30B 15/26; B30B 15/14; B30B 15/148
See application file for complete search history.

(56) References Cited

U.S. PATENT DOCUMENTS 7,392,684 B2 * 7/2008 Iwashita ..... B21D 24/02 72/21.4
2006/0012326 A1 * 1/2006 Iwashita ..... B30B 15/148 318/645

(Continued)

FOREIGN PATENT DOCUMENTS

JP 200715007 A 1/2007
JP 200730009 A 2/2007

(Continued)

*Primary Examiner* — Jessica Cahill
*Assistant Examiner* — Jared O Brown
(74) *Attorney, Agent, or Firm* — Hauptman Ham, LLP

(57) ABSTRACT

A control apparatus of a machine tool includes: a slide position control unit configured to control a slide according to operation patterns; a pressure command generation unit configured to generate a pressure command for a die cushion according to the operation patterns; a pressure detection unit configured to detect an actual pressure of the die cushion; a die cushion speed control unit configured to control the die cushion, based on an error between the pressure command and the actual pressure; and a command reach determination unit configured to determine whether or not the error is greater than a pressure threshold, wherein the slide position control unit sets, based on a result of the determination by the command reach determination unit, a waiting period between the operation pattern at the time of the determination and the next operation pattern, wherein the slide is kept at its position during the waiting period.

7 Claims, 10 Drawing Sheets

(56) References Cited

U.S. PATENT DOCUMENTS

| | | | | |
|---|---|---|---|---|
| 2006/0090656 | A1* | 5/2006 | Iwashita | B21D 24/02 100/43 |
| 2008/0054829 | A1* | 3/2008 | Onishi | G05B 19/19 318/255 |
| 2008/0066515 | A1* | 3/2008 | Iwashita | B21D 24/02 72/351 |
| 2009/0173131 | A1* | 7/2009 | Iwashita | B21D 24/10 72/351 |
| 2014/0305177 | A1* | 10/2014 | Kohno | B21D 24/02 72/21.4 |
| 2022/0250133 | A1* | 8/2022 | Handle | H02P 23/16 |

FOREIGN PATENT DOCUMENTS

| | | | | | |
|---|---|---|---|---|---|
| JP | 200738238 | A | | 2/2007 | |
| JP | 2007111703 | A | * | 5/2007 | B21D 24/02 |
| JP | 2007160356 | A | * | 6/2007 | B21D 24/02 |
| JP | 20086459 | A | | 1/2008 | |

* cited by examiner

CONTROL APPARATUS OF MACHINE TOOL FOR PROCESSING OBJECT TO BE PROCESSED ON DIE CUSHION

RELATED APPLICATIONS

The present application claims priority to Japanese Application Number 2019-197319, filed Oct. 30, 2019, the disclosure of which is hereby incorporated by reference herein in its entirety.

BACKGROUND OF THE INVENTION

1. Field of the Invention

The present invention relates to a control apparatus of a machine tool for processing an object to be processed on a die cushion.

2. Description of the Related Art

Among machine tools for carrying out bending, drawing, die cutting or some other processing, those having a die cushion are known, wherein a certain pressure is applied to the slide that supports a first shaping device (mold) used for the processing, from the support member that supports a second shaping device (die).

A die cushion mechanism tracks the movement of the slide and, in accordance with the position of the cushion pad, applies force in the direction of the slide onto the object to be processed from the moment when the slide comes into contact with the object to be processed and applies pressure to the object to be processed to the moment when the application of the pressure terminates and the slide is detached from the object to be processed. To improve the processing quality, it is preferable that a stable pressure be applied to the object to be processed while the cushion pad tracks the slide.

As is described in, for example, Japanese Unexamined Patent Publication No. 2007-015007, there is known a control system for servo die cushions that includes a slide, a plurality of die cushions for generating a force applied to the slide by using a servomotor as a drive source, and a plurality of control devices respectively controlling the plurality of die cushions, the control system including: a position commanding part for generating a position command of each die cushion; a position detecting part for detecting the position of each die cushion; a force commanding part for generating a force command between the slide and each die cushion; and a force detecting part for detecting a force generated between the slide and each die cushion, characterized in that each control device includes: a first speed commanding part for generating a first speed command of the die cushion controlled by the control device, based on the position command and the position detected by the position detecting part; a second speed commanding part for generating a second speed command of the die cushion, based on the force command and the force detected by the force detecting part; a switch judging part for judging that the command for controlling the die cushion should be switched from the first speed command to the second speed command, or vice versa; and a switching part for switching the command from the first speed command to the second speed command, or vice versa, based on a switching signal, and characterized in that the control system further includes: a switching signal generating part capable of collecting the judgment result of each switch judging part of the plurality of control device, the switching signal generating part being configured to generate a switching signal and transmit the signal to the switching parts of the plurality of control devices, either when the number of control devices, in which the switch judging parts judge the command for controlling the die cushions should be switched from the first speed command to the second speed command, reaches a first predetermined number, or when the number of control devices, in which the switch judging parts judge the command for controlling the die cushions should be switched from the second speed command to the first speed command, reaches a second predetermined number.

As is described in, for example, Japanese Unexamined Patent Publication No. 2008-006459, there is known a press machine including: a drive motor for carrying out pressing; a first conversion mechanism for converting rotational motion of the drive motor to reciprocating motion; a slide that is coupled to the first conversion mechanism and makes reciprocating motion; a die cushion that moves by bearing a load from a mold attached to the slide wherein an object to be processed is held between the die cushion and the mold, characterized in that the press machine includes: an energy conversion device that supports the die cushion movably and generates electric power by the load, and a power line for supplying the power to the drive motor.

As is described in, for example, Japanese Unexamined Patent Publication No. 2007-038238, there is known a control apparatus of a die cushion mechanism using a servomotor as a drive source for generating a force applied to a slide of a press machine, the control apparatus including: a force command unit for giving a command of a force to be applied by the die cushion mechanism; a force detection unit for detecting the force applied to slide by the die cushion mechanism; a force control unit for executing force control on the servomotor when a force detection value detected by the force detection unit is equal to or greater than a value of the force command given by the force command unit during a cooperation from a moment of collision between the slide and the die cushion mechanism to a moment of detachment of the slide and the die cushion mechanism; and an initial value setting unit for newly setting an initial stationary value that serves as a reference to be used by the force command unit in giving a preliminary command value for the collision, every time the slide completes a cycle of press operation by departing from an initial position, performing the cooperation with the die cushion mechanism, and returning to the initial position, wherein the initial value setting unit adopts a value outputted from the force detection unit in a period of stable output, which is a period of the cycle of press operation except for a period of the cooperation between the slide and the die cushion and for a predefined period immediately after the detachment, and sets the value as the initial stationary value.

As is described in, for example, Japanese Unexamined Patent Publication No. 2007-030009, there is known a control apparatus of a press machine that includes a slide using a servomotor as a drive source and a die cushion mechanism using a servomotor as a drive source for generating a force to be applied to the slide, wherein the control apparatus controls the force, the control apparatus including: a slide operation command unit for giving a command for an operation of the slide; at least one of a die cushion operation command unit for giving a command for an operation of the die cushion mechanism and a die cushion operation detection unit for detecting an operation of the die cushion mechanism; and a slide operation correction unit for correcting a slide operation command value generated by the slide operation command unit, based on at least one of a die cushion operation command value generated by the die cushion operation command unit and a die cushion operation detection value detected by the die cushion operation detection unit.

SUMMARY OF INVENTION

In a machine tool for processing an object to be processed on a die cushion by applying pressure from a slide according to a machining program specifying a plurality of operation patterns, a position control system of the slide and a position control system of the die cushion are provided separately. The position of the slide and the pressure of the die cushion are controlled according to the operation patterns specified in the machining program in the respective control systems.

The pressure control system of the die cushion executes control in such a way that the pressure applied to the die cushion (to be referred to as "actual pressure" hereinafter) follows the pressure command. When the pressure control system responds inadequately due to a delay in the control loop or a mechanical delay of the die cushion in response to the pressure command, the actual pressure applied to the die cushion may fail to reach the pressure stipulated by the pressure command, failing to generate a sufficient pressure to be applied to the die cushion for processing the object to be processed. When the position control system of the slide executes position control of the slide shifting from the current operation pattern to the next operation pattern when the actual pressure applied to the die cushion does not reach the pressure stipulated by the pressure command, defects such as wrinkles and cracks may occur on the object to be processed, leading to a problem of quality deterioration. Thus, a control apparatus is desired that allows the prevention of processing quality deterioration due to inadequate responsiveness of the pressure control system of the die cushion of a machine tool for processing an object to be processed on a die cushion by applying pressure from a slide according to a machining program specifying a plurality of operation patterns.

According to one aspect of the present disclosure, a control apparatus of a machine tool for processing an object to be processed on a die cushion by applying pressure from a slide according to a machining program specifying a plurality of operation patterns includes: a slide position control unit configured to execute position control of the slide according to the operation patterns; a pressure command generation unit configured to generate a pressure command that stipulates a pressure to be applied to the die cushion according to the operation patterns; a pressure detection unit configured to detect an actual pressure applied to the die cushion; a die cushion speed control unit configured to execute speed control of the die cushion, based on an error between the pressure command and the actual pressure applied to the die cushion; and a command reach determination unit configured to determine whether or not the error is greater than a certain pressure threshold value, wherein the slide position control unit sets a waiting period between the operation pattern being executed at a point in time of a determination by the command reach determination unit and the operation pattern to be executed immediately after that operation pattern, based on a result of the determination by the command reach determination unit, wherein during the waiting period the slide is kept at a position where the slide was at the point in time of the determination by the command reach determination unit.

BRIEF DESCRIPTION OF THE DRAWINGS

The present invention will be more clearly understood with reference to the following accompanying drawings.

DETAILED DESCRIPTION

Figure 1:
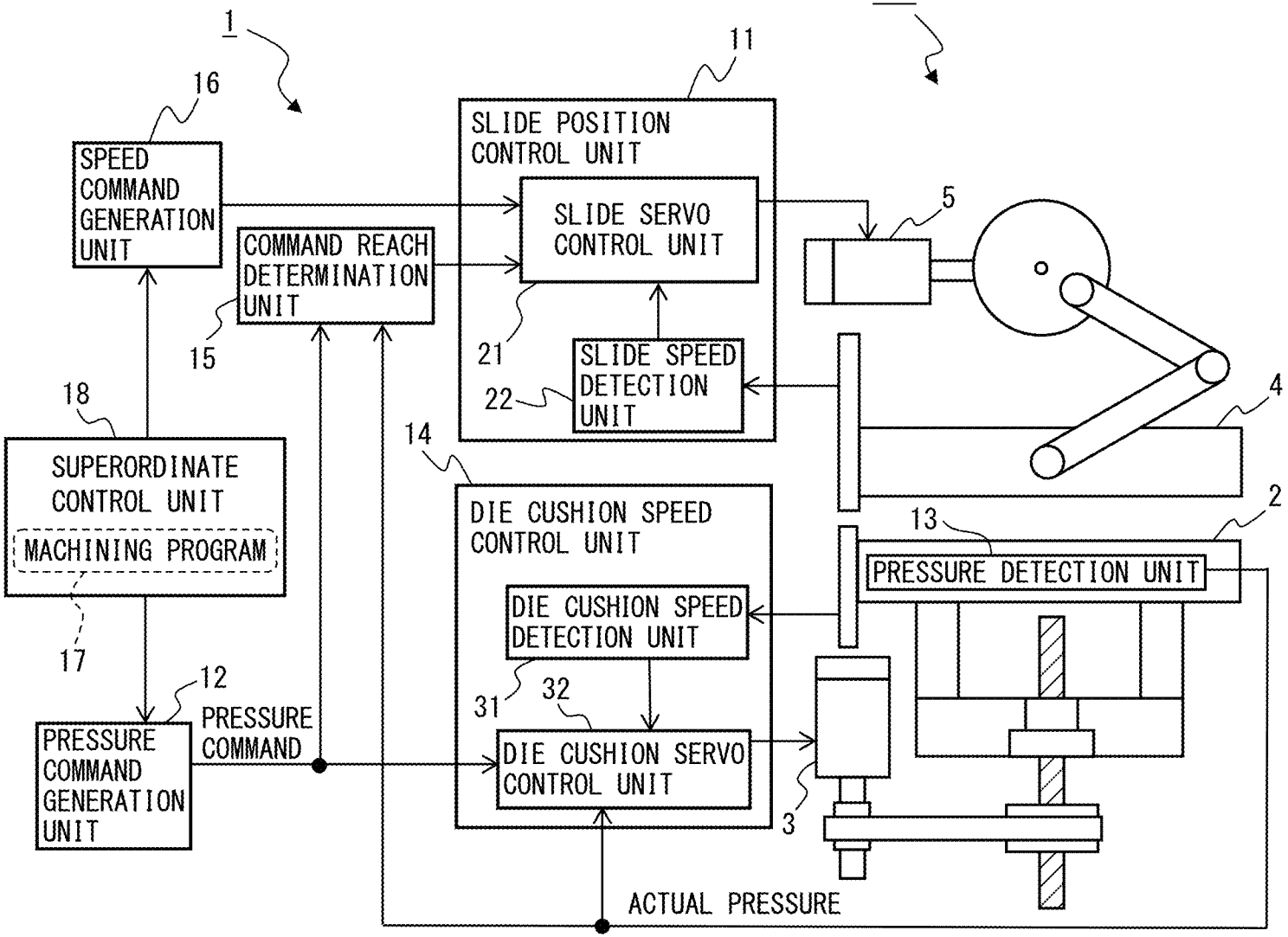
FIG. 1 is a block diagram illustrating a control apparatus of a machine tool having a servo die cushion according to one embodiment of the present disclosure.

A control apparatus of a machine tool for processing an object to be processed on a die cushion will be described below with reference to the drawings. Like members are denoted by like reference signs throughout the drawings. To facilitate understanding, the drawings are presented with different scales as appropriate. The embodiments illustrated in the drawings are merely illustrative and the present invention is not limited to the embodiments illustrated in the drawings.

Figures 10A, 10B, 10C, 10D:
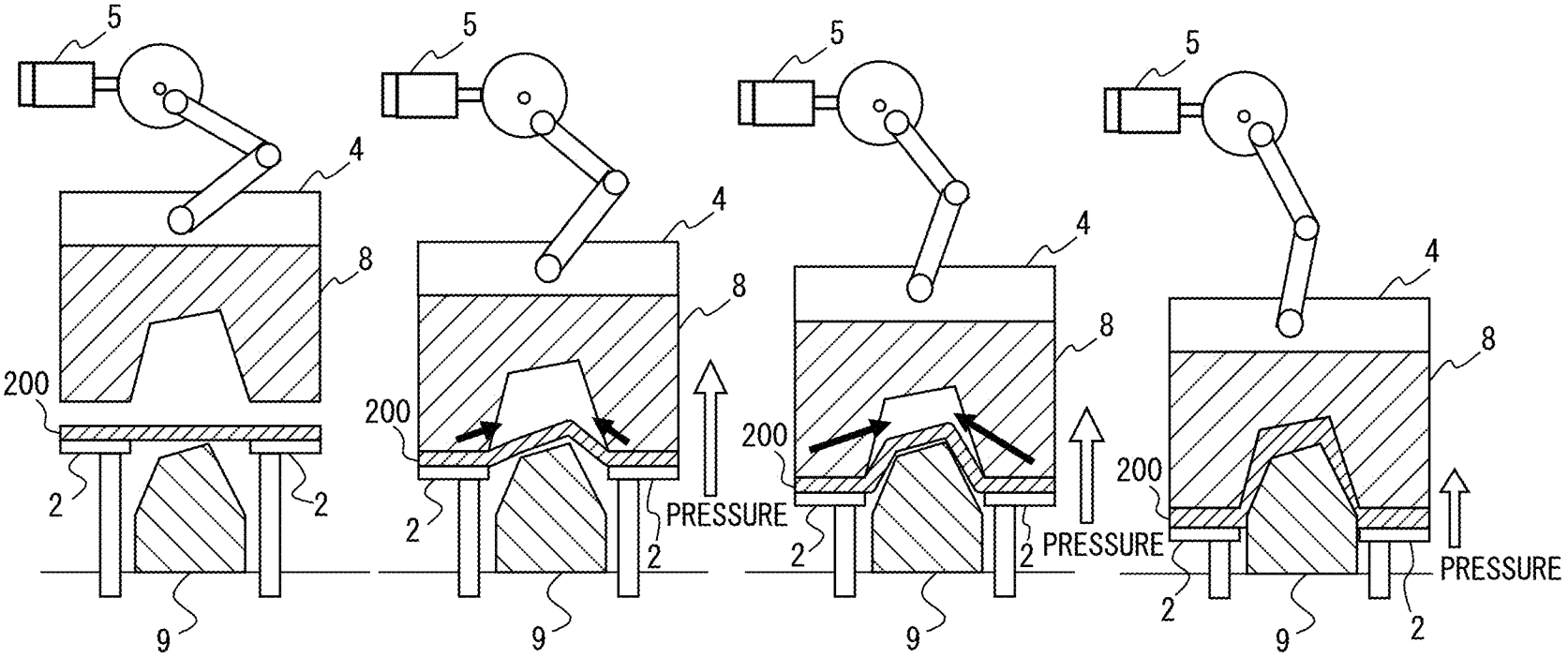
FIGS. 10A to 10D are diagrams illustrating an operation of a machine tool for processing an object to be processed on a die cushion by applying pressure from a slide.

A machine tool for processing an object to be processed on a die cushion by applying pressure from a slide carries out bending, drawing, die cutting or some other processing. An operation of a machine tool for carrying out drawing of an object to be processed on a die cushion by applying pressure from the slide will be described with reference to FIGS. 10A to 10D before a control apparatus of a machine tool according to one embodiment of the present disclosure is described. FIGS. 10A to 10D are diagrams illustrating an operation of a machine tool for processing an object to be processed on a die cushion by applying pressure from a slide. A machine tool for carrying out drawing of an object to be processed, which is a workpiece 200, has the workpiece 200 placed on the die cushion 2 as illustrated in FIG. 10A. A mold 8 is provided for the slide 4 and a die 9 matching the mold 8 is provided beneath the die cushion 2. As is illustrated in FIG. 10B, the slide 4 descends toward the die cushion 2 and, when the mold 8 comes into contact with the workpiece 200, the die cushion 2 moves downward in coordination with the operation of the slide 4, which is driven by the slide motor 5. When the die 9 comes into pressure contact with the workpiece 200, the workpiece 200 gradually changes its shape (FIG. 10C) and, when the slide 4 descends further, the mold 8 comes into pressure contact with the workpiece 200 as illustrated in FIG. 10D, completing the drawing. During this drawing, as the slide 4 comes into contact with the object to be processed, the die cushion 2 abuts the slide 4 with the object to be processed between them, and holds the object to be processed between itself and the slide 4 by applying a certain force toward the slide 4 onto the object to be processed. In the pressure control system of the die cushion, the control is performed in such a way that the actual pressure applied to the die cushion follows the pressure command. However, when the pressure control system responds inadequately due to a delay in the control loop or a mechanical delay of the die cushion in response to the pressure command, the actual pressure applied to the die cushion may fail to reach the pressure stipulated by the pressure command, failing to generate sufficient pressure to be applied to the die cushion for processing the object to be processed. When the position control system of the slide executes the position control of the slide when the actual pressure applied to the die cushion does not reach the pressure stipulated by the pressure command when the operation pattern is shifting from the current operation pattern to the next operation pattern, defects such as wrinkles and cracks may occur on the object to be processed, leading to quality deterioration. A control apparatus of a machine tool according to one embodiment of the present disclosure to be described below allows the prevention of processing quality deterioration due to inadequate responsiveness of the pressure control system of the die cushion.

FIG. 1 is a block diagram illustrating a control apparatus of a machine tool having a servo die cushion according to one embodiment of the present disclosure. The die cushion mechanism of the machine tool according to one embodiment of the present disclosure may be a servo die cushion or an oil hydraulic die cushion. With FIG. 1, an example in which the die cushion mechanism is a servo die cushion will be described.

The machine tool 100 includes a slide 4 driven by a slide motor 5 and a die cushion 2 that moves in coordination with the operation of the slide 4.

The die cushion 2, which is a servo die cushion, is driven by a die cushion motor 3, which is controlled by a die cushion speed control unit 14. The die cushion 2 has a function of abutting the slide 4 with the object to be processed between them as the slide 4 comes into contact with the object to be processed, and of holding the object to be processed between itself and the slide 4 by applying a certain force toward the slide 4 onto the object to be processed.

The die cushion 2 is connected with the shaft of the die cushion motor 3 via, for example, a belt/pulley mechanism and a ball screw mechanism and configured to ascend and descend by converting the rotational motion of the die cushion motor 3 to linear motion via the belt/pulley mechanism and the ball screw mechanism. As an alternative example, the die cushion 2 may be connected with the die cushion motor 3, for example, via gears or, for example, directly connected (coupled) to the die cushion motor 3.

The slide 4 is connected with the shaft of the slide motor 5 via, for example, a belt/pulley mechanism and a ball screw mechanism and configured to ascend and descend by converting the rotational motion of the slide motor 5 to linear motion via the belt/pulley mechanism and a ball screw mechanism. As an alternative example, the slide 4 may be connected with the slide motor 5, for example, via gears or, for example, directly connected (coupled) to the slide motor 5.

A control apparatus 1 according to one embodiment of the present disclosure controls the machine tool 100 in such a way that the machine tool 100 processes the object to be processed on the die cushion 2 by applying pressure from the slide 4 according to a machining program 17 specifying a plurality of operation patterns. The control apparatus 1, which controls the machine tool 100, includes a slide position control unit 11, a pressure command generation unit 12, a pressure detection unit 13, a die cushion speed control unit 14, and a command reach determination unit 15. The control apparatus 1 further includes a speed command generation unit 16 and a superordinate control unit 18.

The superordinate control unit 18 controls the speed command generation unit 16 for controlling the slide 4 and the pressure command generation unit 12 for controlling the die cushion 2 according to the machining program 17 specifying a plurality of operation patterns. Note that in FIG. 1 the superordinate control unit 18 is a superordinate control unit commonly provided for the slide position control unit 11 and the die cushion speed control unit 14. As an alternative example, for example, superordinate control units 18 independent from each other may be respectively provided for the slide position control unit 11 and the die cushion speed control unit 14, and these independent superordinate control units 18 may be respectively provided with a machining program 17 specifying operation patterns for the slide position control unit 11 and a machining program 17 specifying operation patterns for the die cushion speed control unit 14.

The machining program 17 is formulated in accordance with the contents of the processing of the machine tool 100. The die cushion 2 and the slide 4 operate in accordance with the contents of the processing of the machine tool 100. The machining program 17 specifies a plurality of operation patterns. Each operation pattern specified in the machining program 17 is a combination of a segment of a constant operation of the die cushion 2 and a corresponding segment of a constant operation of the slide 4. A change in at least one of the speed or acceleration of the slide 4 and the pressure command for the die cushion 2 at a point in time entails a change of operation patterns at that point in time. For example, when there is more than one kind of segment of a constant operation of the die cushion 2 for the period of one segment of constant operation of the slide 4, one operation pattern is formed by taking one segment of a constant operation among the plurality of kinds of operations as one unit. As a concrete example, when there are two kinds of pressure commands for the die cushion 2 stipulating a first value and a second value for the period in which the slide 4 descends at a constant speed toward the object to be processed (i.e., toward the die cushion 2), one operation pattern is formed by the combination of the slide 4 descending at the constant speed and the die cushion 2 operating in accordance with the pressure command at the first value, and one operation pattern is formed by the combination of the slide 4 descending at the constant speed and the die cushion 2 operating in accordance with the pressure command at the second value. Further, for example, when there is more than one kind of segment of a constant operation of the slide 4 for the period of one segment of constant operation of the die cushion 2, one operation pattern is formed by taking one segment of a constant operation among the plurality of kinds of operations as one unit. As a concrete example, when there are two kinds of speed commands for the slide 4 stipulating a first value and a second value for the period in which a pressure command at a constant value is given to the die cushion 2, one operation pattern is formed by the combination of the die cushion 2 operating in accordance with the pressure command and the slide 4 descending in accordance with the speed command at the first value, and one operation pattern is formed by the combination of the die cushion 2 operating in accordance with the pressure command and the slide 4 descending in accordance with the speed command at the second value.

The speed command generation unit 16 generates a speed command for the slide motor 5. The speed command generated by the speed command generation unit 16 is based on the machining program 17 and sent to the slide position control unit 11.

The slide position control unit 11 executes position control of the slide 4 according to the operation patterns specified in the machining program 17. To do so, the slide position control unit 11 includes a slide servo control unit 21 and a slide speed detection unit 22.

The slide speed detection unit 22 detects the speed of the slide 4. The slide servo control unit 21 controls the rotational drive of the slide motor 5, based on the speed command generated by the speed command generation unit 16 and the speed of the slide 4 detected by the slide speed detection unit 22. The slide servo control unit 21 is connected with an inverter (not illustrated) that converts DC power and outputs AC power for driving the slide motor 5. The slide servo control unit 21 controls the rotational drive of the slide motor 5 by controlling the power conversion operation of the inverter. By controlling the rotational drive of the slide motor 5, the slide servo control unit 21 controls the position (or the speed) of the slide 4. Note that, although an example of controlling the speed of the slide 4 has been described, alternatively, the speed of the slide motor 5 itself may be controlled. In such a case, the speed command generation unit 16 generates a speed command for the slide motor 5 and the slide speed detection unit 22 detects the rotational speed of the slide motor 5, and the slide servo control unit 21 controls the rotational drive of the slide motor 5, based on the speed command for the slide motor 5 and the rotational speed of the slide motor 5 detected by the slide speed detection unit 22.

The pressure command generation unit 12 generates a pressure command to stipulate the pressure to be applied to the die cushion 2 according to the operation patterns. The pressure command generated by the pressure command generation unit 12 is based on the machining program 17 and sent to the die cushion speed control unit 14.

The pressure detection unit 13 detects the actual pressure applied to the die cushion 2. The actual pressure applied to the die cushion 2 is the actual pressure applied to the object to be processed by the die cushion 2, i.e., the pressure generated between the die cushion 2 and the slide 4. The pressure detection unit 13 is attached, for example, to a part of the die cushion 2 with which the object to be processed comes into contact when pressure is applied by the slide 4, and the pressure detection unit 13 can detect the actual pressure applied to the object to be processed on the die cushion 2 (i.e., the reaction force of the force applied by the die cushion 2 to the slide 4). For a pressure detection unit 13 as described, a pressure sensor or the like is commonly used. As an alternative example, the pressure detection unit 13 may be attached to a part of the slide 4 with which the object to be processed comes into contact when pressure is applied to the object to be processed, and the actual pressure applied to the slide 4 that is detected in this case is also the reaction force of the force applied by the die cushion 2 to the slide 4, as in the case when the pressure detection unit 13 is provided on the die cushion 2. As another alternative example, the actual pressure applied to the object to be processed may be calculated by arithmetic processing.

The die cushion speed control unit 14 executes speed control of the die cushion 2 according to the operation patterns specified by the machining program 17, based on the error between the pressure command received from the pressure command generation unit 12 and the actual pressure applied to the die cushion 2, detected by the pressure detection unit 13. To do so, the die cushion speed control unit 14 includes a die cushion servo control unit 32 and a die cushion speed detection unit 31.

The die cushion speed detection unit 31 detects the speed of the die cushion 2. The die cushion servo control unit 32 controls the rotational drive of the die cushion motor 3 based on the error between the pressure command generated by the pressure command generation unit 12 and the actual pressure applied on the die cushion 2, detected by the pressure detection unit 13. The die cushion servo control unit 32 is connected with an inverter (not illustrated) that converts DC power and outputs AC power for driving the die cushion motor 3. The die cushion servo control unit 32 controls the rotational drive of the die cushion motor 3 by controlling the power conversion operation of the inverter. Note that, although an example of controlling the speed of the die cushion 2 has been described, alternatively, the speed of the die cushion motor 3 itself may be controlled. In such a case, the pressure command generation unit 12 generates a pressure command for the die cushion motor 3 and the die cushion speed detection unit 31 detects the rotational speed of the die cushion motor 3, and the die cushion servo control unit 32 controls the rotational drive of the die cushion motor 3, based on the speed command for the die cushion motor 3 and the rotational speed of the die cushion motor 3 detected by the die cushion speed detection unit 31. The ascending and descending speed of the die cushion 2 is controlled by controlling the rotational drive of the die cushion motor 3 and, as a result, the pressure to be applied to the die cushion 2 is controlled.

The command reach determination unit 15 determines whether or not the pressure command for the die cushion 2 and the actual pressure on the die cushion 2 are in agreement by determining whether or not the error between the pressure command generated by the pressure command generation unit 12 and the actual pressure applied on the die cushion 2, detected by the pressure detection unit 13, is greater than a certain pressure threshold value. In other words, the pressure threshold value is used for determining whether or not the pressure command generated by the pressure command generation unit 12 and the actual pressure applied on the die cushion 2, detected by the pressure detection unit 13, are in agreement. The pressure threshold value may be set at discretion in accordance with the usage environment and the like of the machine tool 100 and may be, for example, set at approximately a few percent of the maximum value of the actual pressure detected by the pressure detection unit 13. For example, by setting the pressure threshold value at 0 (zero), a complete agreement between the pressure command for the die cushion 2 and the actual pressure on the die cushion 2 can be detected. The command reach determination unit 15 determines whether or not the error between the pressure command and the actual pressure is greater than the pressure threshold value at a point in time earlier by a certain period of time (for example, from tens of microseconds to hundreds of microseconds) than the point in time when the operation pattern executed in the machine tool 100 is switched over. The command reach determination unit 15 determines whether or not the error between the pressure command and the actual pressure is greater than the pressure threshold value successively also during the waiting period, which will be described later.

According to the result of the determination by the command reach determination unit 15, the above-described slide position control unit 11 sets a waiting period between the operation pattern being executed at the point in time of the determination by the command reach determination unit 15 and the operation pattern to be executed immediately after that operation pattern, wherein during the waiting period the slide 4 is kept at the position where the slide 4 was at the point in time of the determination by the command reach determination unit 15. More specifically, when the command reach determination unit 15 has determined that the error between the pressure command and the actual pressure is greater than the pressure threshold value, the slide position control unit 11 sets a waiting period between the operation pattern being executed at the point in time of the determination by the command reach determination unit 15 and the operation pattern to be executed immediately after that operation pattern, wherein during the waiting period the slide 4 is kept at the position where the slide 4 was at the point in time of the determination by the command reach determination unit 15 that the error between the pressure command and the actual pressure is greater than the pressure threshold value. During the waiting period, the slide position control unit 11 executes control in such a way that the slide 4 is kept at the position where the slide 4 was at the point in time of the determination by the command reach determination unit 15 that the error between the pressure command and the actual pressure is greater than the pressure threshold value and, during this time also, the command reach determination unit 15 executes determination processing. When, during the waiting period, the command reach determination unit 15 has determined that the error between the pressure command and the actual pressure is equal to or smaller than the pressure threshold value, the slide position control unit 11 terminates the waiting period and executes position control of the slide according to the operation pattern to be executed next (i.e., the operation pattern immediately after that waiting period). When a smaller pressure threshold value is used for the determination by the command reach determination unit 15 of agreement or disagreement between the pressure command and the actual pressure, the precision of agreement between the pressure command and the actual pressure increases and the processing quality of the machine tool 100 improves, but it takes longer to terminate the waiting period and may result in a prolonged processing time of the machine tool 100.

Thus, according to the control apparatus 1 of the machine tool 100 according to one embodiment of the present disclosure, when the error between the pressure command for the die cushion 2 and the actual pressure applied to the die cushion 2 is greater than the pressure threshold value (i.e., the actual pressure applied to the die cushion 2 has not reached the pressure stipulated by the pressure command), there is no transition from the operation pattern currently being executed to the next operation pattern but a waiting period is set during which the slide 4 is kept at the current position. When the error between the pressure command and the actual pressure becomes equal to or smaller than the pressure threshold value during the waiting period, the waiting period is terminated and the next operation pattern (i.e., the operation pattern immediately after that waiting period) is executed, as it can be assumed that the actual pressure applied to the die cushion 2 has almost reached the pressure stipulated by the pressure command and that a sufficient pressure for processing the object to be processed is applied by the die cushion.

The slide position control unit 11 executes position control of the slide 4 according to the operation pattern after the transition. According to one embodiment of the present disclosure, as there is no transition to the next operation pattern when the actual pressure applied to the die cushion 2 has not reached the pressure stipulated by the pressure command, the object to be processed will not have defects such as wrinkles and cracks and it is possible to prevent processing quality deterioration due to inadequate responsiveness of the pressure control system of the die cushion 2.

An example in which the die cushion mechanism is a servo die cushion has been described above. The die cushion mechanism of the machine tool according to one embodiment of the present disclosure may be an oil hydraulic die cushion.

Figure 2:
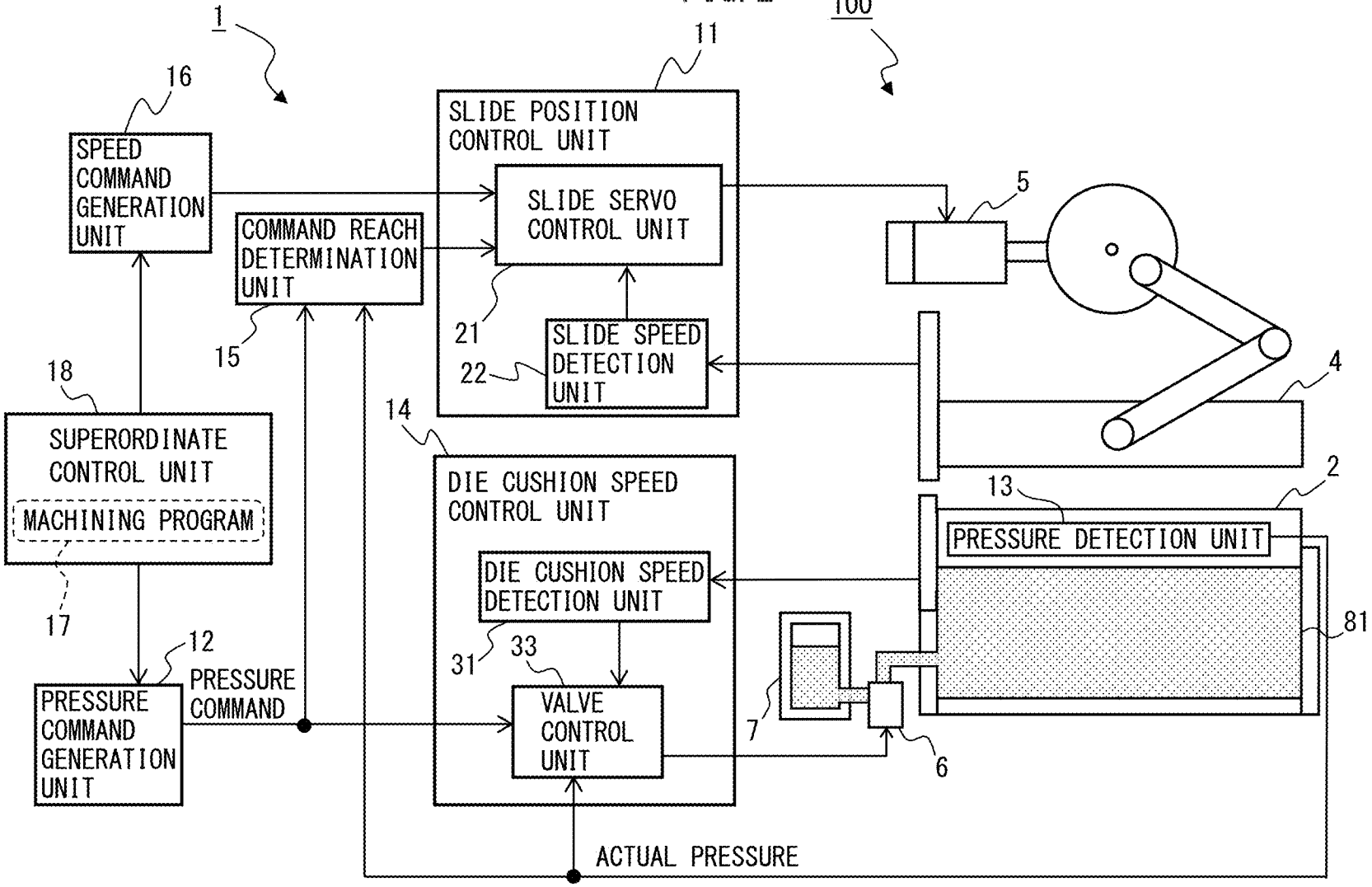
FIG. 2 is a block diagram illustrating a control apparatus of a machine tool having an oil hydraulic die cushion according to one embodiment of the present disclosure.

FIG. 2 is a block diagram illustrating a control apparatus of a machine tool having an oil hydraulic die cushion according to one embodiment of the present disclosure. The cushion pad of a die cushion 2, which is an oil hydraulic die cushion, is connected with, for example, a cylinder 81. The die cushion 2, which is an oil hydraulic die cushion, is configured to ascend and descend when the volume of oil in an oil tank 7 and a cylinder 81 is adjusted by means of a valve 6 controlled by a die cushion speed control unit 14. The die cushion speed control unit 14 includes a valve control unit 33 and a die cushion speed detection unit 31 and controls the pressure to be applied to the die cushion 2 by adjusting the speed of the die cushion 2. A valve control unit 33 controls the opening and closing of the valve 6 to adjust the volume of oil in the oil tank 7 and the cylinder 81, based on the error between the pressure command generated by a pressure command generation unit 12 and the actual pressure applied on the die cushion 2, detected by a pressure detection unit 13. As the volume of oil in the cylinder 81 is increased, the pressure applied to the object to be processed on the die cushion 2 (i.e., the reaction force of the force applied by the die cushion 2 to the slide 4) is increased. As the constituent components of the circuit except for the valve 6, the oil tank 7, the cylinder 81, and the valve control unit 33 are the same as those illustrated in FIG. 1, like constituent components are denoted by like reference signs and will not be described in further detail. Note that, as a modified example, the oil hydraulic die cushion may be an air die cushion, wherein the oil in the oil tank 7 is substituted with air.

The slide position control unit 11, the pressure command generation unit 12, the die cushion speed control unit 14, the command reach determination unit 15, the speed command generation unit 16, and the superordinate control unit 18 described above may be configured by, for example, a software program or a combination of various electronic circuits and a software program. In such a case, the functions of these units can be fulfilled by running a software program on an arithmetic processing unit such as CPU, MPU, and DSP. Alternatively, the slide position control unit 11, the pressure command generation unit 12, the die cushion speed control unit 14, the command reach determination unit 15, the speed command generation unit 16, and the superordinate control unit 18 may be configured as a semiconductor integrated circuit with a software program written therein for fulfilling the functions of these units. Further, the slide position control unit 11, the pressure command generation unit 12, the die cushion speed control unit 14, the command reach determination unit 15, the speed command generation unit 16, and the superordinate control unit 18 may be provided in the main control apparatus (not illustrated) of the machine tool 100. In such a case, the functions of these units can be fulfilled by running the software program on arithmetic processing units such as CPU, MPU, and DSP in the main control apparatus of the machine tool 100.

Figure 3:
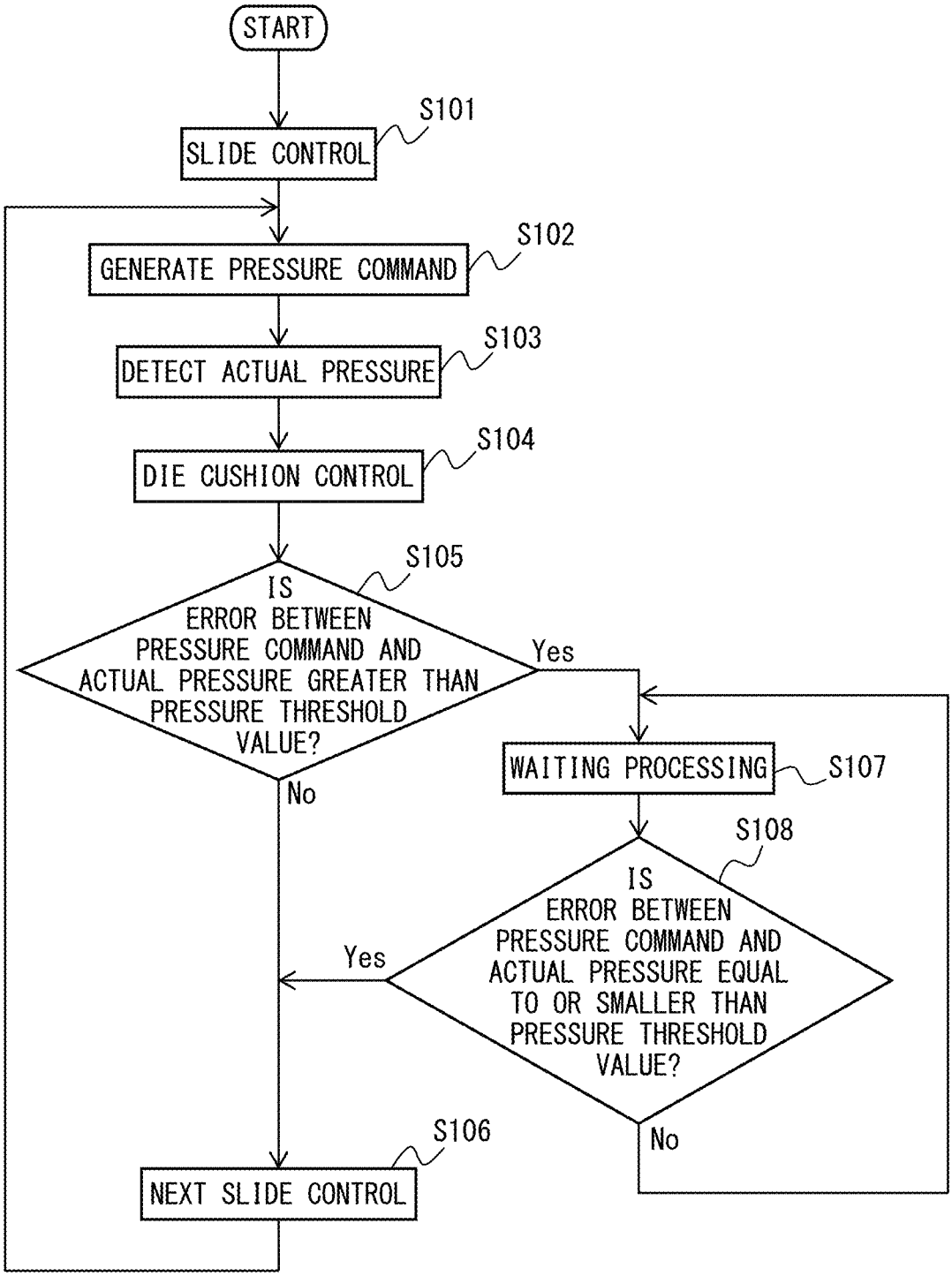
FIG. 3 is a flow chart illustrating an operational flow of a control apparatus of a machine tool according to one embodiment of the present disclosure.

FIG. 3 is a flow chart illustrating an operational flow of a control apparatus of a machine tool according to one embodiment of the present disclosure. In the machine tool 100 illustrated in FIG. 1 or FIG. 2, an object to be processed on the die cushion 2 is processed by applying pressure from the slide 4.

At Step S101, the slide position control unit 11 executes position control of the slide 4 according to the operation patterns specified by the machining program 17, based on the speed command generated by the speed command generation unit 16 and the speed of the slide 4 detected by the slide speed detection unit 22.

At Step S102, the pressure command generation unit 12 generates a pressure command to stipulate the pressure to be applied to the die cushion 2 according to the operation patterns specified by the machining program 17.

At Step S103, the pressure detection unit 13 detects the actual pressure applied to the die cushion 2.

At Step S104, the die cushion speed control unit 14 executes speed control of the die cushion 2 according to the operation patterns specified by the machining program 17, based on the error between the pressure command received from the pressure command generation unit 12 and the actual pressure applied to the die cushion 2, detected by the pressure detection unit 13.

Step S105 is executed at a point in time earlier by a certain period of time (for example, from tens of microseconds to hundreds of microseconds) than the point in time when the operation pattern executed in the machine tool 100 is switched over. At Step S105, the command reach determination unit 15 determines whether or not the error between the pressure command generated by the pressure command generation unit 12 and the actual pressure applied on the die cushion 2, detected by the pressure detection unit 13 is greater than the pressure threshold value.

When it has been determined at Step S105 that the error between the pressure command and the actual pressure is greater than the pressure threshold value, the processing proceeds to Step S107 and, when it has not been determined that the error between the pressure command and the actual pressure is greater than the pressure threshold value (i.e., when the error between the pressure command and the actual pressure is equal to or smaller than the pressure threshold value), the processing proceeds to Step S106.

At Step S107, the slide position control unit 11 sets a waiting period between the operation pattern currently being executed and the operation pattern to be executed immediately after that operation pattern, wherein during the waiting period the slide 4 is kept at the position where the slide 4 was at the point in time of the execution of Step S105. During the waiting period, the slide position control unit 11 executes control in such a way that the slide 4 is kept at the position where the slide 4 was at the point in time of the execution of Step S105 and the processing at Step S108 is executed.

Step S108 is executed during the waiting period. At Step S108, the command reach determination unit 15 determines whether or not the error between the pressure command generated by the pressure command generation unit 12 and the actual pressure applied on the die cushion 2, detected by the pressure detection unit 13, has become equal to or smaller than the pressure threshold value. When the command reach determination unit 15 has determined at Step S108 that the error between the pressure command and the actual pressure has become equal to or smaller than the pressure threshold value, the slide position control unit 11 terminates the waiting period as it can be assumed that a sufficient pressure for processing the object to be processed is applied by the die cushion, and the processing proceeds to Step S106. On the other hand, when the command reach determination unit 15 has not determined at Step S108 that the error between the pressure command and the actual pressure has become equal to or smaller than the pressure threshold value, the waiting period is maintained as it can be assumed that a sufficient pressure for processing the object to be processed is not yet applied to the die cushion, and the slide 4 is kept at the position where the slide 4 was at the point in time of the execution of Step S105. The processing then returns to Step S107.

At Step S106, the slide position control unit 11 executes position control of the slide 4 according to the next operation pattern and the processing returns to Step S102.

Next, a few examples will be described to illustrate relations between the position of slide 4 and the pressure applied to the die cushion 2 with respect to the control apparatus 1 of the machine tool 100 according to one embodiment of the present disclosure.

Figure 4A:
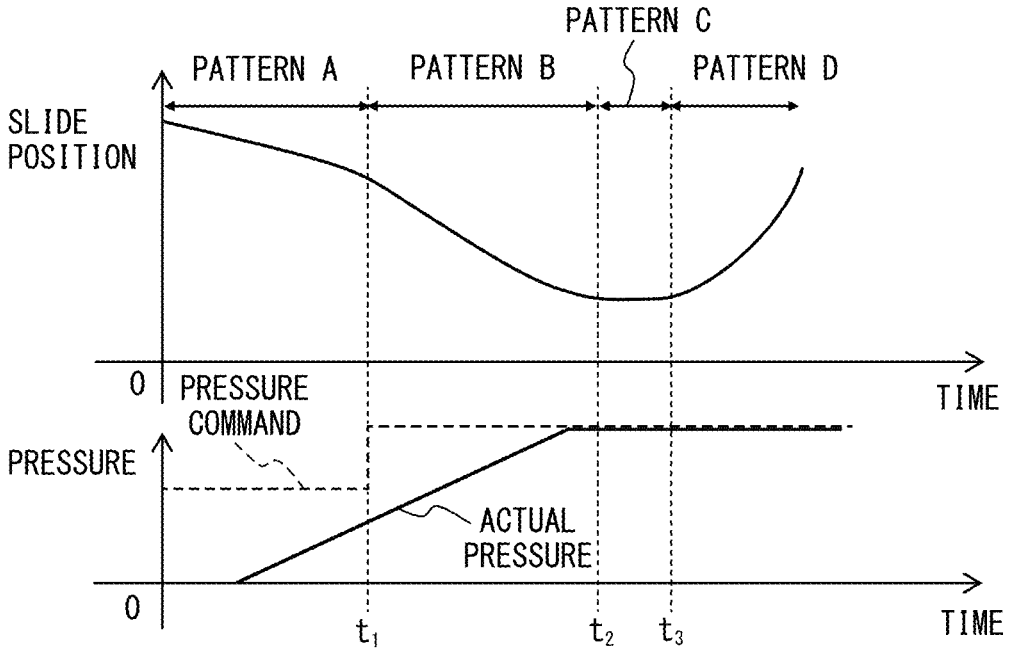
FIG. 4A is a diagram illustrating a relation between the position of the slide and the pressure of the die cushion in a case in which the speed command to the slide and the pressure command to the die cushion are simultaneously switched over between different operation patterns, illustrating an application of a conventional technique paying no heed to how closely the actual pressure follows the pressure command at the time of the switchover between the operation patterns.
Figure 4B:
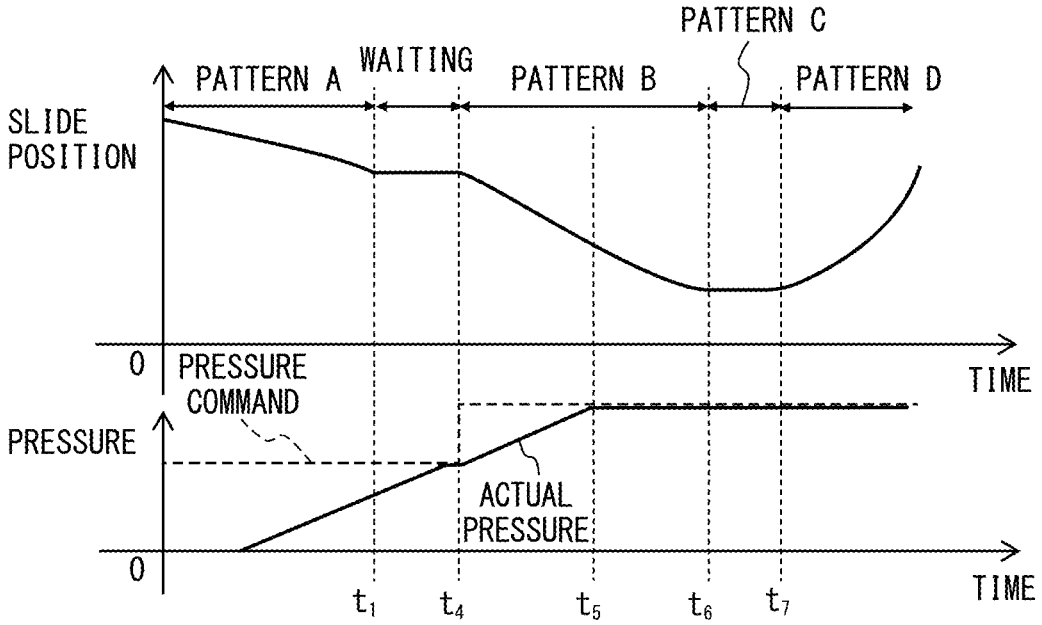
FIG. 4B is a diagram illustrating a relation between the position of the slide and the pressure of the die cushion in a case in which the speed command to the slide and the pressure command to the die cushion are simultaneously switched over between different operation patterns, illustrating an application of one embodiment of the present disclosure.

FIG. 4A is a diagram illustrating a relation between the position of the slide and the pressure of the die cushion in a case in which the speed command to the slide and the pressure command to the die cushion are simultaneously switched over between different operation patterns, illustrating an application of a conventional technique paying no heed to how closely the actual pressure follows the pressure command at the time of the switchover between the operation patterns. FIG. 4B is a diagram illustrating a relation between the position of the slide and the pressure of the die cushion in a case in which the speed command to the slide and the pressure command to the die cushion are simultaneously switched over between different operation patterns, illustrating an application of one embodiment of the present disclosure.

In the examples illustrated in FIG. 4A and FIG. 4B, the operations of the slide 4 and the die cushion 2 are carried out according to pattern A from time 0 to time $t_1$, switched from pattern A to pattern B at time $t_1$, switched from pattern B to pattern C at time $t_2$, and switched from pattern C to pattern D at time $t_3$. The speed commands for the slide 4 in patterns A to D are all different while only the pressure command for the die cushion 2 in pattern A is different from those in patterns B to D. In pattern C, which lasts from time $t_2$ to time $t_3$, the slide 4 is at the lowest point and the speed stipulated by the speed command is zero. In pattern D, which is from time 3, the slide 4 is caused to ascend while the pressure applied to the die cushion 2 is maintained.

Here, a case will be discussed in which the actual pressure of the die cushion 2 has not reached the pressure stipulated by the pressure command at time $t_1$, when the operations are to be switched from pattern A to pattern B. In pattern A, the slide 4 is caused to descend at a certain constant speed while a pressure command for a certain constant pressure is given to the die cushion 2. When the slide 4 comes into contact with the object to be processed, the processing starts, using the mold provided on the slide 4, and a pressure is applied to die cushion 2 on which the object to be processed is placed. As illustrated in 4A, according to a conventional technique paying no heed to how closely the actual pressure follows the pressure command, when the operation pattern is switched from pattern A to pattern B at time $t_1$, the actual pressure of the die cushion 2 has not reached the pressure stipulated by the pressure command at time $t_1$, and defects such as wrinkles and cracks will be caused on the object to be processed by the processing at this point in time. In contrast, as illustrated in FIG. 4B, according to the control apparatus 1 according to one embodiment of the present disclosure, at time $t_1$, when the operation pattern is switched from pattern A to pattern B, the command reach determination unit 15 determines that the error between the pressure command and the actual pressure is greater than the pressure threshold value; hence the slide position control unit 11 sets a waiting period between pattern A being executed and operation pattern B to be executed after pattern A, wherein during the waiting period the slide 4 is kept at the position where the slide 4 was at time $t_1$, which is the point in time when the command reach determination unit 15 determined that the error between the pressure command and the actual pressure was greater than the pressure threshold value. During the waiting period, the slide position control unit 11 executes control in such a way that the slide 4 is kept at the position where the slide 4 was at time $t_1$. After that, the actual pressure gradually comes close to the pressure stipulated by the pressure command, and at time $t_4$, when the actual pressure reaches the pressure stipulated by the pressure command, the command reach determination unit 15 determines that the error between the pressure command and the actual pressure has become equal to or smaller than the pressure threshold value. Thus, the slide position control unit 11 terminates the waiting period at time $t_4$, and starts position control of the slide 4, based on pattern B. Thus, according to one embodiment of the present disclosure, at time $t_1$, when pattern A terminates, there is no transition to pattern B as the actual pressure has not reached the pressure stipulated by the pressure command, and the transition to pattern B takes place only at time $t_4$, when the actual pressure reaches the pressure stipulated by the pressure command. Therefore, the processing based on pattern B is carried out when a sufficient pressure for processing the object to be processed is applied by the die cushion 2, which prevents defects such as wrinkles and cracks from occurring on the object to be processed as in the case of the conventional technique.

Figure 5A:
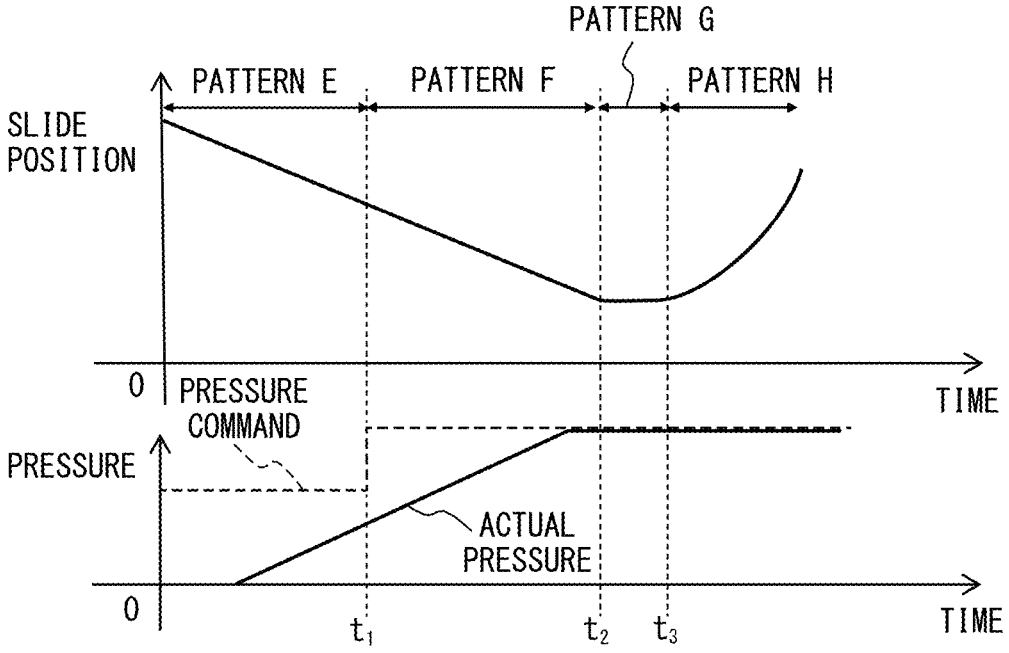
FIG. 5A is a diagram illustrating a relation between the position of the slide and the pressure of the die cushion in a case in which only the pressure command is switched over between different operation patterns, illustrating an application of a conventional technique paying no heed to how closely the actual pressure follows the pressure command at the time of the switchover between the operation patterns.
Figure 5B:
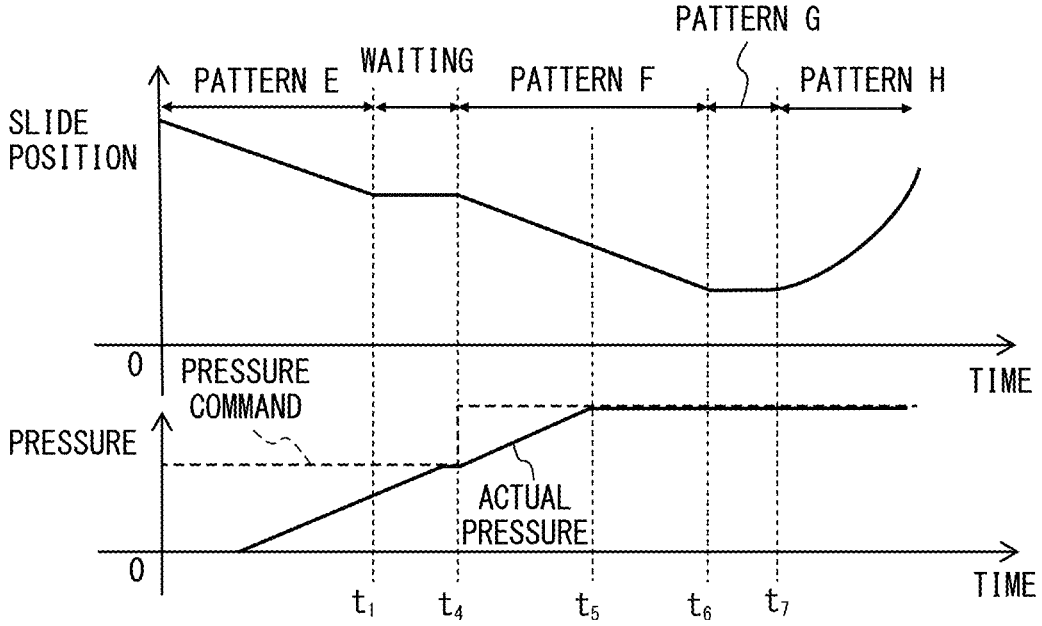
FIG. 5B is a diagram illustrating a relation between the position of the slide and the pressure of the die cushion in a case in which only the pressure command is switched over between different operation patterns, illustrating an application of one embodiment of the present disclosure.

FIG. 5A is a diagram illustrating a relation between the position of the slide and the pressure of the die cushion in a case in which only the pressure command is switched over between different operation patterns, illustrating an application of a conventional technique paying no heed to how closely the actual pressure follows the pressure command at the time of the switchover between the operation patterns. FIG. 5B is a diagram illustrating a relation between the position of the slide and the pressure of the die cushion in a case in which only the pressure command is switched over between different operation patterns, illustrating an application of one embodiment of the present disclosure.

In the examples illustrated in FIG. 5A and FIG. 5B, the operations of the slide 4 and the die cushion 2 are carried out according to pattern E from time 0 to time $t_1$, switched from pattern E to pattern F at time $t_1$, switched from pattern F to pattern G at time $t_2$, and switched from pattern G to pattern H at time $t_3$. The slide 4 is caused to descend at a certain constant speed from time 0 to time $t_2$ while the pressure command is switched to a greater value at time $t_1$. In other words, the speed command for slide 4 stipulates the same value in pattern E and pattern F while the pressure command for the die cushion 2 stipulates different values. In pattern G, which lasts from time $t_2$ to time $t_3$, the slide 4 is at the lowest point and the speed stipulated by the speed command is zero. In pattern H, which is from time $t_3$, the slide 4 is caused to ascend while the pressure applied to the die cushion 2 is maintained.

Here, a case will be discussed in which the actual pressure of the die cushion 2 has not reached the pressure stipulated by the pressure command at time $t_1$, when the operations are to be switched from pattern E to pattern F. In pattern E, the slide 4 is caused to descend at a certain constant speed while a pressure command for a certain constant pressure is given to the die cushion 2. When the slide 4 comes into contact with the object to be processed, the processing starts, using the mold provided on the slide 4, and a pressure is applied to die cushion 2 on which the object to be processed is placed. As illustrated in 5A, according to a conventional technique paying no heed to how closely the actual pressure follows the pressure command, when the operation pattern is switched from pattern E to pattern F at time $t_1$, the actual pressure of the die cushion 2 has not reached the pressure stipulated by the pressure command at time $t_1$, and defects such as wrinkles and cracks will be caused on the object to be processed by the processing at this point in time. In contrast, as illustrated in FIG. 5B, according to the control apparatus 1 according to one embodiment of the present disclosure, at time $t_1$, when the operation pattern is switched from pattern E to pattern F, the command reach determination unit 15 determines that the error between the pressure command and the actual pressure is greater than the pressure threshold value; hence the slide position control unit 11 sets a waiting period between pattern E being executed and operation pattern F to be executed after pattern E, wherein during the waiting period the slide 4 is kept at the position where the slide 4 was at time $t_1$, which is the point in time when the command reach determination unit 15 determined that the error between the pressure command and the actual pressure was greater than the pressure threshold value. During the waiting period, the slide position control unit 11 executes control in such a way that the slide 4 is kept at the position where the slide 4 was at time $t_1$. After that, the actual pressure gradually comes close to the pressure stipulated by the pressure command, and at time $t_4$, when the actual pressure reaches the pressure stipulated by the pressure command, the command reach determination unit 15 determines that the error between the pressure command and the actual pressure has become equal to or smaller than the pressure threshold value. Thus, the slide position control unit 11 terminates the waiting period at time $t_4$, and starts position control of the slide 4, based on pattern F. Thus, according to one embodiment of the present disclosure, at time $t_1$, when pattern E terminates, there is no transition to pattern F as the actual pressure has not reached the pressure stipulated by the pressure command, and the transition to pattern F takes place only at time $t_4$, when the actual pressure reaches the pressure stipulated by the pressure command. Therefore, the processing based on pattern F is carried out when a sufficient pressure for processing the object to be processed is applied by the die cushion 2, which prevents defects such as wrinkles and cracks from occurring on the object to be processed as in the case of the conventional technique.

Figure 6A:
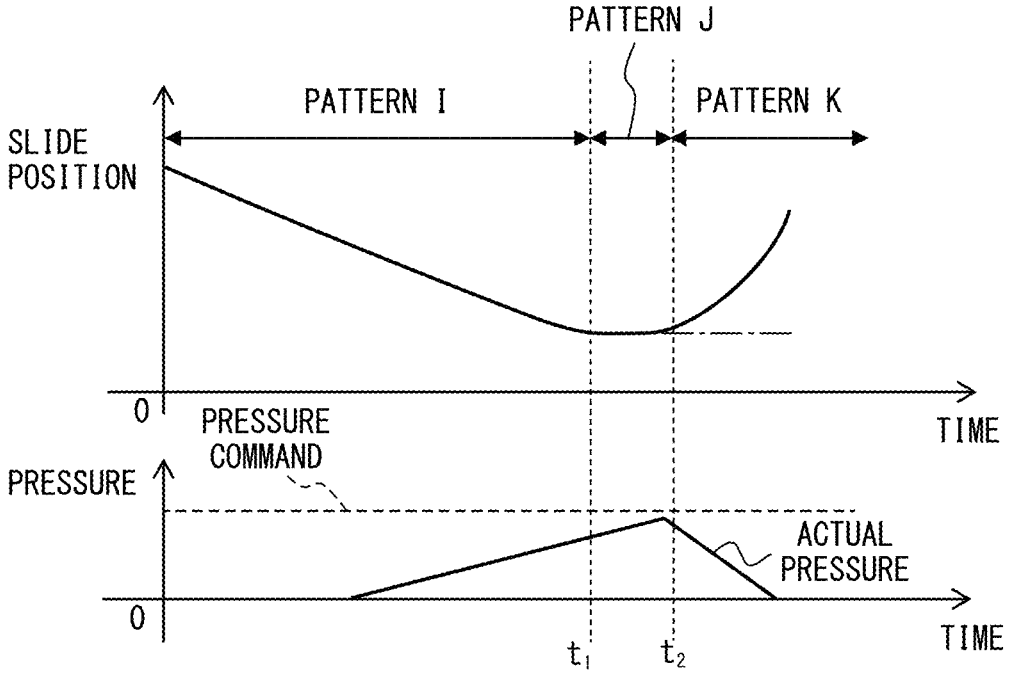
FIG. 6A is a diagram illustrating a relation between the position of the slide and the pressure of the die cushion in a case in which the actual pressure applied to the die cushion has not reached the pressure stipulated by the pressure command at the time when the slide has reached the lowest point, illustrating an application of a conventional technique paying no heed to how closely the actual pressure follows the pressure command at the time of the switchover between the operation patterns.
Figure 6B:
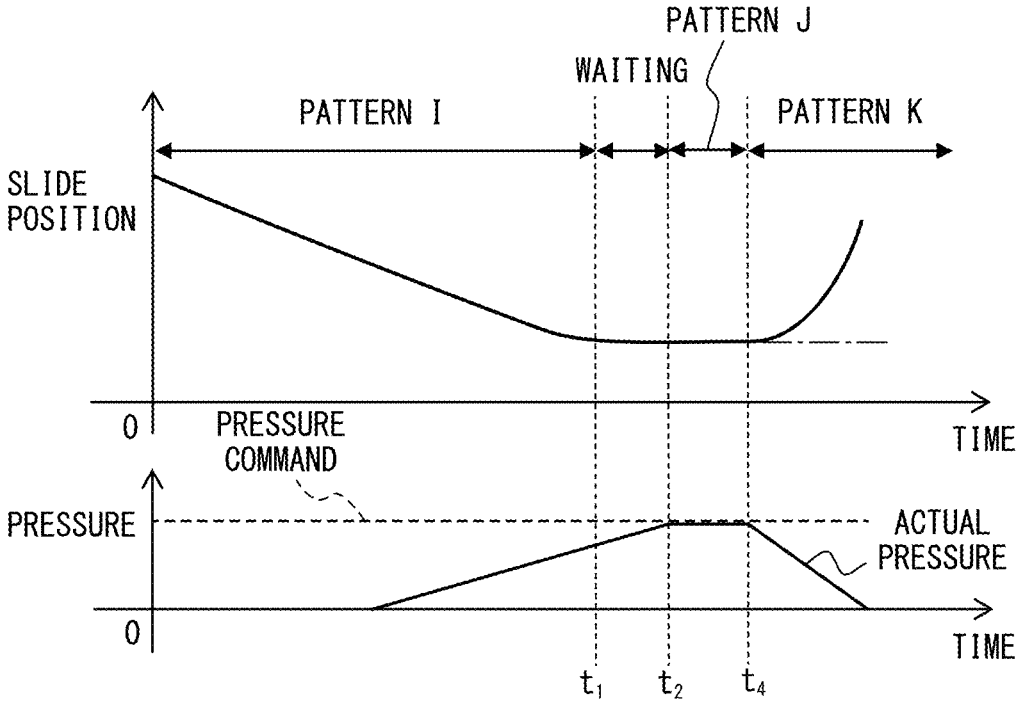
FIG. 6B is a diagram illustrating a relation between the position of the slide and the pressure of the die cushion in a case in which the actual pressure applied to the die cushion has not reached the pressure stipulated by the pressure command at the time when the slide has reached the lowest point, illustrating an application of one embodiment of the present disclosure.

FIG. 6A is a diagram illustrating a relation between the position of the slide and the pressure of the die cushion in a case in which the actual pressure applied to the die cushion has not reached the pressure stipulated by the pressure command at the time when the slide has reached the lowest point, illustrating an application of a conventional technique paying no heed to how closely the actual pressure follows the pressure command at the time of the switchover between the operation patterns. FIG. 6B is a diagram illustrating a relation between the position of the slide and the pressure of the die cushion in a case in which the actual pressure applied to the die cushion has not reached the pressure stipulated by the pressure command at the time when the slide has reached the lowest point, illustrating an application of one embodiment of the present disclosure.

In the examples illustrated in FIG. 6A and FIG. 6B, the operations of the slide 4 and the die cushion 2 are carried out according to pattern I from time 0 to time $t_1$, switched from pattern I to pattern J at time $t_1$, and switched from pattern J to pattern K at time $t_2$. The pressure command for the die cushion 2 stipulates a constant value from patterns I to K. The slide 4 is caused to descend at a constant speed from time 0 to time $t_1$ (pattern I) and, in pattern J, which lasts from time $t_1$ to time $t_2$, the slide 4 is at the lowest point and the speed stipulated by the speed command is zero. In pattern K, which is from time $t_2$, the actual pressure applied to the die cushion 2 decreases as the position of the slide 4 ascends.

Here, a case will be discussed in which the actual pressure of the die cushion 2 has not reached the pressure stipulated by the pressure command in pattern J, which lasts from time $t_1$ to time $t_2$, when the slide 4 is at the lowest point. In pattern J, the slide 4 is in contact with the object to be processed and the processing is carried out using the mold provided on the slide 4 and the die provided below the die cushion 2 and, although a pressure is applied to the die cushion 2 on which the object to be processed is placed, the pressure has not reached the pressure stipulated by the pressure command and a sufficient pressure for processing the object to be processed is not applied to the die cushion 2. As illustrated in FIG. 6A, according to a conventional technique paying no heed to how closely the actual pressure follows the pressure command, in pattern J, which lasts from time $t_1$ to time $t_2$, when the slide 4 is at the lowest point, the actual pressure applied to the die cushion 2 has not reached the pressure stipulated by the pressure command and a sufficient pressure for processing the object to be processed is not applied to the die cushion 2; however, at time $t_2$, the processing according to pattern K is carried out. As a sufficient pressure for processing the object to be processed is not applied to the die cushion 2 when the slide 4 is at the lowest point, defects such as wrinkles and cracks will occur on the object to be processed. In contrast, as illustrated in FIG. 6B, according to the control apparatus 1 according to one embodiment of the present disclosure, the actual pressure applied to the die cushion 2 has not reached the pressure stipulated by the pressure command at time $t_1$, when the slide 4 is at the lowest point. Thus, the command reach determination unit 15 determines that the error between the pressure command and the actual pressure is greater than the pressure threshold value and the slide position control unit 11 sets a waiting period between pattern I being executed and operation pattern J to be executed immediately after pattern I, wherein during the waiting period the slide 4 is kept at the position where the slide 4 was at time $t_1$, which is the point in time when the command reach determination unit 15 determined that the error between the pressure command and the actual pressure was greater than the pressure threshold value. Thus, during the waiting period, the slide position control unit 11 controls in such a way that the slide 4 is kept at the current position, which is at the lowest point. After that, while the slide 4 is positioned at the lowest point, the actual pressure gradually comes close to the pressure stipulated by the pressure command and, at time $t_4$, when the actual pressure reaches the pressure stipulated by the pressure command, the command reach determination unit 15 determines that the error between the pressure command and the actual pressure has become equal to or smaller than the pressure threshold value and hence the slide position control unit 11 terminates the waiting period and starts position control of the slide 4 based on pattern J. Thus, as the slide 4 is positioned at the lowest point also in pattern J, the slide 4 stays at the lowest point all through the waiting period, which starts at time $t_1$, as well as pattern J, which terminates at time $t_4$. In other words, the slide 4 stays at the lowest position until a sufficient pressure for processing the object to be processed is applied by the die cushion 2. Thus, according to one embodiment of the present disclosure, at time $t_1$, when pattern I terminates, the actual pressure has not reached the pressure stipulated by the pressure command and the operation pattern does not switch to pattern J; and at time $t_4$, when the actual pressure reaches the pressure stipulated by the pressure command, the operation pattern switches to pattern K. Therefore, the processing based on pattern J is carried out when a sufficient pressure for processing the object to be processed is applied by the die cushion 2, which prevents defects such as wrinkles and cracks from occurring on the object to be processed.

One embodiment of the present disclosure can be applied to a control apparatus of a machine tool for processing objects to be processed that are positioned on a plurality of die cushions by applying pressure from a single slide. A control apparatus of such a machine tool will be described as a modified example of one embodiment of the present disclosure.

Figure 7:
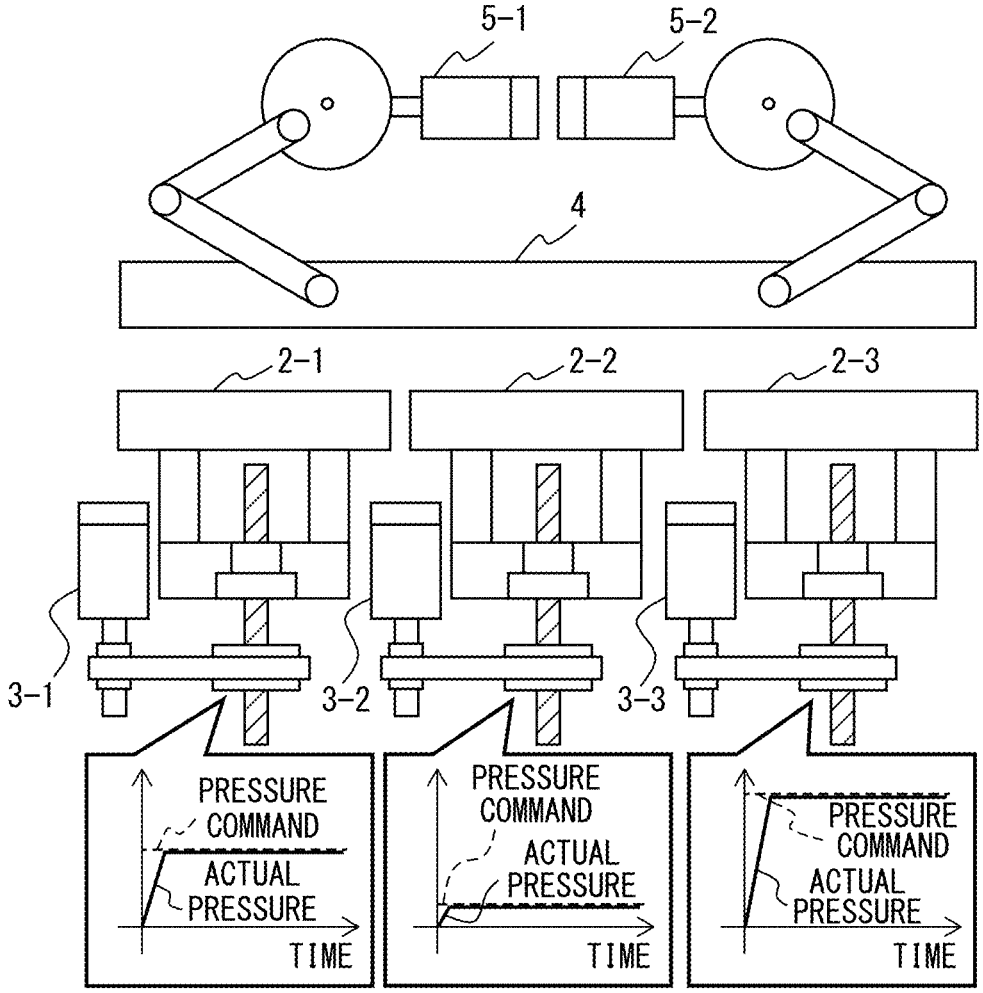
FIG. 7 is a diagram illustrating a machine tool for processing objects to be processed that are positioned on a plurality of die cushions by applying pressure from a single slide.

FIG. 7 is a diagram illustrating a machine tool for processing objects to be processed that are positioned on a plurality of die cushions by applying pressure from a single slide.

With FIG. 7, an example in which the die cushion mechanism is a servo die cushion will be described. Note that, in FIG. 7, there is no illustration for the slide position control unit 11, the pressure command generation unit 12, the pressure detection unit 13, the die cushion speed control unit 14, the command reach determination unit 15, the speed command generation unit 16, or the superordinate control unit 18, as these units have been described with reference to FIG. 1.

The slide 4 is driven by slide motors 5-1 and 5-2. A plurality of die cushions 2-1, 2-2, and 2-3 are respectively driven by die cushion motors 3-1, 3-2, and 3-3. Although three die cushions are illustrated in FIG. 7, this is as an example and there may be two die cushions or more than three die cushions. On the die cushions 2-1, 2-2, and 2-3, objects to be processed are respectively placed and the plurality of objects to be processed can be processed by ascending and descending operation of the single slide 4. Different pressure commands may be given to the die cushions 2-1, 2-2, and 2-3 depending on the contents of the processing of the object to be processed. As the pressure controls for the die cushions 2-1, 2-2, and 2-3 are executed independently, the die cushions 2-1, 2-2, and 2-3 are different in how closely the actual pressure follows the pressure command. According to a first modification example and a second modification example of one embodiment of the present disclosure, a waiting period is set when the error between the pressure command and the actual pressure is greater than a certain pressure threshold value with respect to at least one of the plurality of die cushions 2-1, 2-2, and 2-3. Note that, as the pressure controls for the die cushions 2-1, 2-2, and 2-3 are executed independently, the pressure commands for the die cushions 2-1, 2-2, and 2-3 are changed at different timings and hence the operation patterns are also changed at different timings. Thus, when the operation pattern is switched over with respect to at least one of the die cushions 2-1, 2-2, and 2-3, the command reach determination unit 15 executes determination processing for all of the die cushions 2-1, 2-2, and 2-3 at a point in time earlier by a certain period of time (for example, from tens of microseconds to hundreds of microseconds) than the point in time when the operation pattern is switched over.

Figure 8:
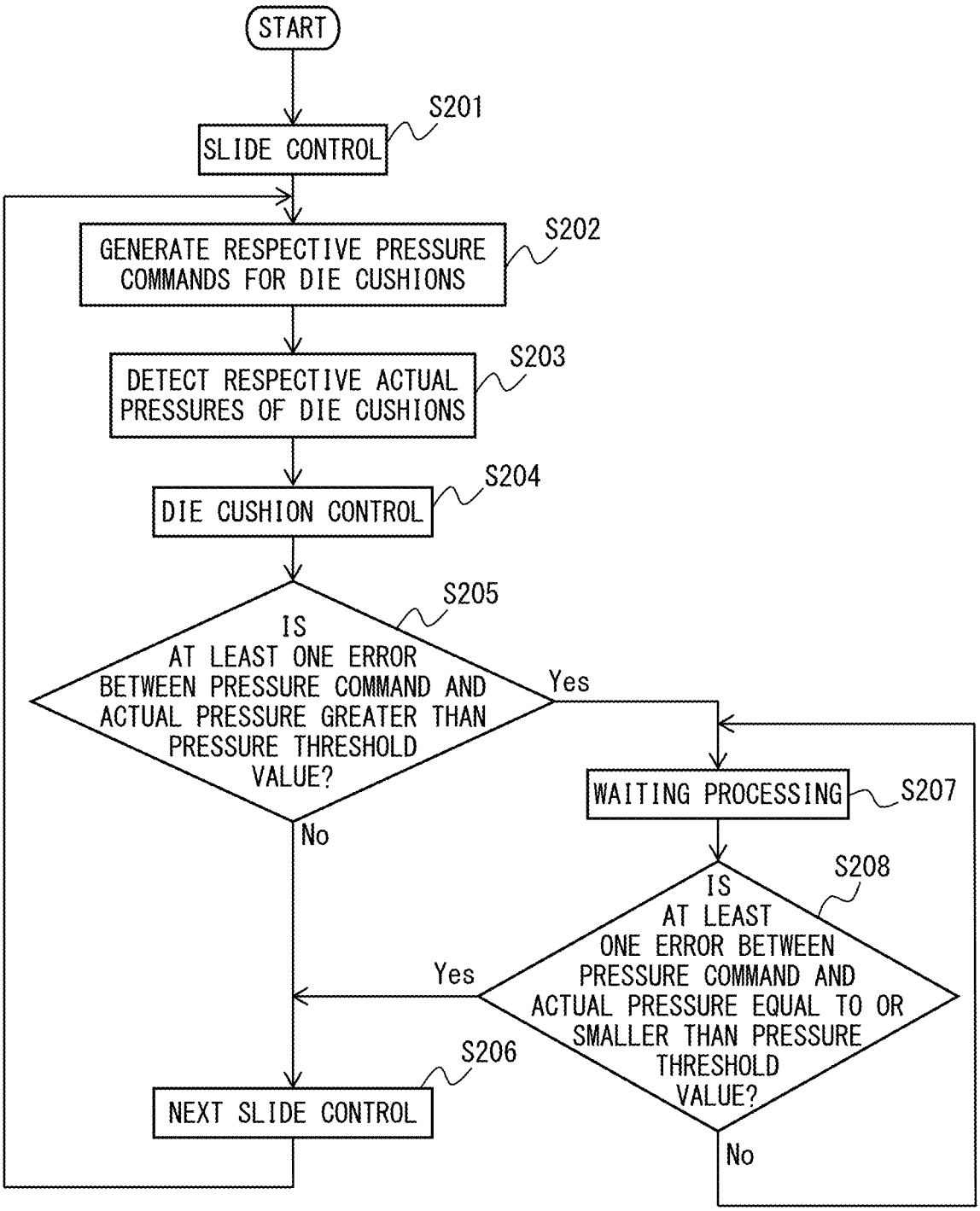
FIG. 8 is a flow chart illustrating an operational flow of a control apparatus of a machine tool according to a first modification example of one embodiment of the present disclosure.

FIG. 8 is a flow chart illustrating an operational flow of a control apparatus of a machine tool according to a first modification example of one embodiment of the present disclosure. Here, an example will be described in which objects to be processed on the die cushion 2-1, 2-2, and 2-3 are processed by applying pressure from the single slide 4 of the machine tool illustrated in FIG. 7. Although three die cushions are illustrated in FIG. 7 but this is as an example and there may be two die cushions or more than three die cushions.

At Step S201, the slide position control unit 11 executes position control of the single slide 4 according to the operation patterns specified by the machining program 17, based on the speed command generated by the speed command generation unit 16 and the speed of the slide 4 detected by the slide speed detection unit 22.

At Step S202, the pressure command generation unit 12 generates respective pressure commands for the die cushions 2-1, 2-2, and 2-3 according to the operation patterns specified by the machining program 17.

At Step S203, the pressure detection unit 13 detects the actual pressures respectively applied to the die cushions 2-1, 2-2, and 2-3.

At Step S204, the die cushion speed control unit 14 executes speed control respectively of the die cushions 2-1, 2-2, and 2-3 according to the operation patterns specified by the machining program 17, based respectively on the errors between the pressure commands and the actual pressures corresponding to the die cushions 2-1, 2-2, and 2-3.

Step S205 is executed at a point in time earlier by a certain period of time (for example, from tens of microseconds to hundreds of microseconds) than the point in time when the operation pattern executed in the machine tool 100 is switched over. At Step S205, with respect to each of the die cushions 2-1, 2-2, and 2-3, the command reach determination unit 15 compares the error between the pressure command and the actual pressure corresponding to the die cushion with the pressure threshold value to determine which is greater.

When, as the result of the comparison by the command reach determination unit 15, it has been determined that, with respect to at least one die cushion of the die cushions 2-1, 2-2, and 2-3, the error is greater than the pressure threshold value, the processing proceeds to Step S207. When, as the result of the comparison by the command reach determination unit 15, it has not been determined that, with respect to at least one die cushion of the die cushions 2-1, 2-2, and 2-3, the error is greater than the pressure threshold value (i.e., when it has been determined that, with respect to at least one of the die cushions 2-1, 2-2, and 2-3, the error is equal to or smaller than the pressure threshold value), the processing proceeds to Step S206.

Step S207 is executed when, as the result of the comparison by the command reach determination unit 15, it has been determined at Step S205 that, with respect to at least one die cushion of the die cushions 2-1, 2-2, and 2-3, the error is greater than the pressure threshold value. At Step S207, the slide position control unit 11 sets a waiting period between the operation pattern currently being executed and the operation pattern to be executed immediately after that operation pattern, wherein during the waiting period the slide 4 is kept at the position where the slide 4 was at the point in time when Step S205 was executed. During the waiting period, the slide position control unit 11 executes control in such a way that the slide 4 is kept at its position, and the processing proceeds to Step S208. Thus, according to the first modification example, when, with respect to at least one die cushion of the plurality of die cushions 2-1, 2-2, and 2-3, the actual pressure has not reached the pressure stipulated by the pressure command at a point in time earlier by a certain period of time (for example, from tens of microseconds to hundreds of microseconds) than the point in time when the operation pattern is switched over, the slide 4 is kept at its position at that point in time.

The Step S208 is executed during the waiting period. At Step S208, with respect to each of the die cushions 2-1, 2-2, and 2-3, the command reach determination unit 15 compares the error between the pressure command and the actual pressure corresponding to the die cushion with the pressure threshold value to determine which is greater. When, as the result of the comparison by the command reach determination unit 15, it has been determined that, with respect to at least one die cushion of the die cushions 2-1, 2-2, and 2-3, the error is equal to or smaller than the pressure threshold value, the processing proceeds to Step S206. When, as the result of the comparison by the command reach determination unit 15, it has not been determined that, with respect to at least one die cushion of the die cushions 2-1, 2-2, and 2-3, the error is equal to or smaller than the pressure threshold value, the processing returns to Step S207.

At Step S206, the slide position control unit 11 executes position control of the slide 4 according to the next operation pattern, and the processing returns to Step S202.

As has been described above, according to the first modification example, at Step S208, which is executed during the waiting period, the command reach determination unit 15 determines whether or not to terminate the waiting period, based on whether or not, with respect to at least one die cushion of the die cushions 2-1, 2-2, and 2-3, the error is equal to or smaller than the pressure threshold value. In a second modification example to be described next, the command reach determination unit 15 determines whether or not to terminate the waiting period, based on whether or not the error is equal to or smaller than the pressure threshold value with respect to all of the die cushions 2-1, 2-2, and 2-3.

Figure 9:
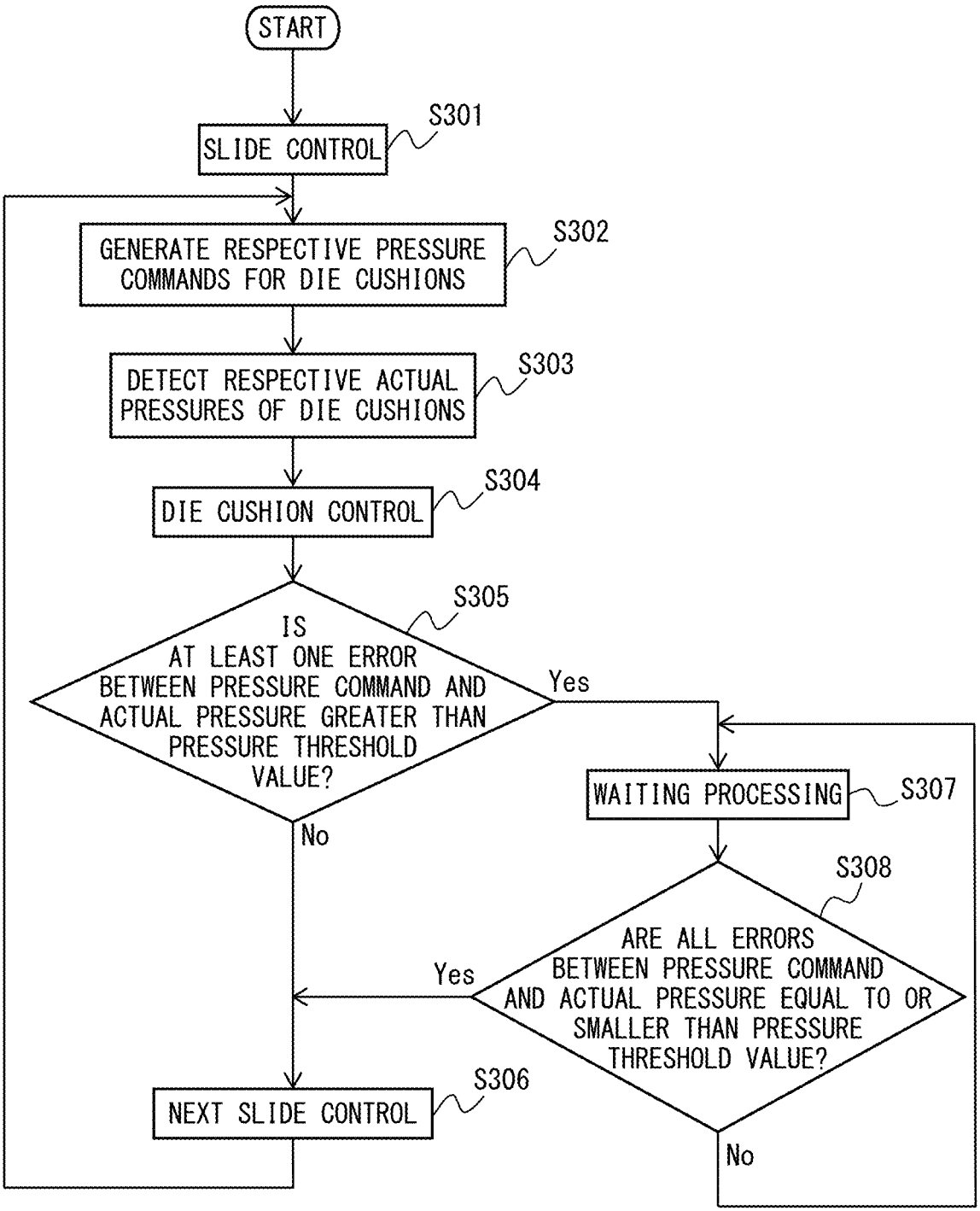
FIG. 9 is a flow chart illustrating an operational flow of a control apparatus of a machine tool according to a second modification example of one embodiment of the present disclosure.

FIG. 9 is a flow chart illustrating an operational flow of a control apparatus of a machine tool according to a second modification example of one embodiment of the present disclosure. Here, an example will be described in which objects to be processed on the die cushion motors 3-1, 3-2, and 3-3 are processed by applying pressure from the single slide 4 with respect to the machine tool illustrated in FIG. 7. Although three die cushions are illustrated in FIG. 7, this is as an example and there may be two die cushions or more than three die cushions.

The processing from Step S301 to S307 is the same as the processing from Step S201 to S207, which has been described with reference to FIG. 8. Step S308 is executed during the waiting period. At Step S208, with respect to each of the die cushions 2-1, 2-2, and 2-3, the command reach determination unit 15 compares the error between the pressure command and the actual pressure corresponding to the die cushion with the pressure threshold value to determine which is greater. When, as the result of the comparison by the command reach determination unit 15, it has been determined that, with respect to all of the die cushions 2-1, 2-2, and 2-3, the error is equal to or smaller than the pressure threshold value, the processing proceeds to Step S306. When, as the result of the comparison by the command reach determination unit 15, it has not been determined that, with respect to all of the die cushions 2-1, 2-2, and 2-3, the error is equal to or smaller than the pressure threshold value (i.e., it has been determined that, with respect to at least one die cushion of the die cushions 2-1, 2-2, and 2-3, the error is greater than the pressure threshold value), the processing returns to Step S307. According to the second modification example, the waiting period does not terminate unless it is determined that, with respect to all of the plurality of die cushions 2-1, 2-2, and 2-3, the error is equal to or smaller than the pressure threshold value, wherein during the waiting period the slide 4 is kept at the current position; hence no defects such as wrinkles and cracks will occur on any of the objects to be processed placed on the plurality of die cushions 2-1, 2-2, and 2-3 and it is possible to prevent more effectively processing quality deterioration due to inadequate responsiveness of the pressure control system of the die cushion.

Thus, according to the first modification example and the second modification example according to one embodiment of the present disclosure, it is possible to prevent processing quality deterioration due to inadequate responsiveness of the pressure control system of the die cushion with respect also to a machine tool for processing objects to be processed that are positioned on a plurality of die cushions by applying pressure from a single slide.

According to one aspect of the present disclosure, in a machine tool for processing an object to be processed on a die cushion by applying pressure from a slide according to a machining program specifying a plurality of operation patterns, a control apparatus is realized that allows the prevention of processing quality deterioration due to inadequate responsiveness of the pressure control system of the die cushion.

The invention claimed is:

1. A control apparatus of a machine tool for processing an object to be processed on a die cushion by applying pressure from a slide according to a machining program specifying a plurality of operation patterns, the control apparatus comprising:

a pressure sensor configured to detect an actual pressure applied to the die cushion; and a processor configured to execute position control of the slide according to the plurality of operation patterns, generate a pressure command that stipulates a pressure to be applied to the die cushion according to the plurality of operation patterns, execute speed control of the die cushion, based on an error between the pressure command and the actual pressure applied on the die cushion, and perform a determination of whether or not the error is greater than a certain pressure threshold value, wherein the processor is configured to set a waiting period between a first operation pattern of the plurality of operation patterns being executed at a point in time of the determination and a second operation pattern of the plurality of operation patterns to be executed immediately after the first operation pattern, based on a result of the determination, wherein during the waiting period the slide is kept at a position where the slide was at during the point in time of the determination.

2. The control apparatus of the machine tool according to claim 1, wherein the processor is configured to set the waiting period in response to the determination that the error is greater than the certain pressure threshold value.

3. The control apparatus of the machine tool according to claim 1, wherein the processor is configured to perform the determination of whether or not the error is greater than the certain pressure threshold value at a point in time earlier by a certain period of time than a point in time when an operation pattern of the plurality of operation patterns being executed is switched over.

4. The control apparatus of the machine tool according to claim 3, wherein the processor is configured to terminate the waiting period, and execute the position control of the slide according to a next operation pattern of the plurality of operation patterns to be executed next in response to the processor determining that the error is equal to or smaller than the certain pressure threshold value during the waiting period, which was set based on the determination that the error is greater than the certain pressure threshold value.

5. The control apparatus of the machine tool according to claim 1, wherein the machine tool processes objects to be processed that are positioned on a plurality of die cushions by applying pressure from the slide, wherein the pressure sensor is configured to detect the actual pressure applied to each of the plurality of die cushions, and wherein the processor is configured to generate the pressure command for each of the plurality of die cushions, execute speed control of each of the plurality of die cushions, based on the error between the pressure command to a corresponding die cushion of the plurality of die cushions and the actual pressure corresponding to the corresponding die cushion, determine with respect to each of the plurality of die cushions whether or not the error between the pressure command and the actual pressure with respect to the corresponding die cushion is greater than the certain pressure threshold value at a point in time earlier by a certain period of time than a point in time when an operation pattern of the plurality of operation patterns being executed is switched over, and set the waiting period in response to the processor determining that, with respect to at least one of the plurality of die cushions, the error between the pressure command and the actual pressure is greater than the certain pressure threshold value.

6. The control apparatus of the machine tool according to claim 5, wherein the processor is configured to, in response to the processor determining that, with respect to the at least one of the plurality of die cushions, the error between the pressure command and the actual pressure is equal to or smaller than the certain pressure threshold value during the waiting period, terminate the waiting period, and execute position control of the slide according to a next operation pattern of the plurality of operation patterns to be executed next.

7. The control apparatus of the machine tool according to claim 5, wherein the processor is configured to, in response to the processor determining that, with respect to all of the plurality of die cushions, the error between the pressure command and the actual pressure is equal to or smaller than the certain pressure threshold value during the waiting period, terminate the waiting period, and execute position control of the slide according to a next operation pattern of the plurality of operation patterns to be executed next.

* * * * *